US011217193B2

(12) United States Patent
Huang et al.

(10) Patent No.: US 11,217,193 B2
(45) Date of Patent: Jan. 4, 2022

(54) DISPLAY DEVICE AND SIGNAL-PROCESSING METHOD THEREOF

(71) Applicant: InnoLux Corporation, Miao-Li County (TW)

(72) Inventors: Kuan-Hsien Huang, Miao-Li County (TW); Ho-Tien Chen, Miao-Li County (TW); Yi-Cheng Chang, Miao-Li County (TW); Hung-Chiao Wu, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 0 days.

(21) Appl. No.: 16/904,651

(22) Filed: Jun. 18, 2020

(65) Prior Publication Data

US 2021/0012736 A1 Jan. 14, 2021

Related U.S. Application Data

(60) Provisional application No. 62/873,278, filed on Jul. 12, 2019.

(30) Foreign Application Priority Data

Apr. 24, 2020 (CN) ..... 202010332743.4

(51) Int. Cl.

| | |
|---|---|
| ***G09G 5/10*** | (2006.01) |
| ***G09G 3/36*** | (2006.01) |
| ***G09G 3/3225*** | (2016.01) |
| ***G09G 3/20*** | (2006.01) |

(52) U.S. Cl.

CPC ..... *G09G 3/3648* (2013.01); *G09G 3/2074* (2013.01); *G09G 3/3225* (2013.01); *G09G 2320/0626* (2013.01)

(58) Field of Classification Search

CPC .. G09G 3/3648; G09G 3/2074; G09G 3/3225; G09G 2320/0626; G09G 3/3208; G09G 3/3216; G09G 2330/02

USPC ..... 345/690

See application file for complete search history.

(56) References Cited

U.S. PATENT DOCUMENTS

2014/0218421 A1* 8/2014 Lee ..... G09G 3/2011 345/692
2014/0354699 A1* 12/2014 Shin ..... G09G 3/2022 345/690
2015/0070407 A1* 3/2015 Lee ..... G09G 3/3233 345/690

* cited by examiner

*Primary Examiner* — Jennifer T Nguyen

(74) *Attorney, Agent, or Firm* — McClure, Qualey & Rodack, LLP

(57) ABSTRACT

A signal-processing method for a display device, including: receiving a frame signal; and converting the frame signal into a plurality of sub-frame signals in a number of N corresponding to N different sub-frame duties, wherein N is a positive integer equal to or greater than 2. Therefore, the display device using a drive module with lower bits may have a resolution with higher bits to improve the display quality of the electronic device.

14 Claims, 7 Drawing Sheets

DISPLAY DEVICE AND SIGNAL-PROCESSING METHOD THEREOF

CROSS REFERENCE TO RELATED APPLICATIONS

This application claims priority of U.S. Provisional Application No. 62/873,278, filed Jul. 12, 2019 and China Patent Application No. 202010332743.4, filed on Apr. 24, 2020, the entirety of which are incorporated by reference herein.

BACKGROUND OF THE DISCLOSURE

Field of the Disclosure

The present disclosure relates to a signal-processing method, and in particular it relates to a display device and a signal-processing method thereof.

Description of the Related Art

The light-emitting unit of a conventional electronic device may generate light with a brightness that corresponds to a particular gray level. However, due to the limitations of drive modules, a display device using the drive module with lower bits may not have a resolution with high bits. This can negatively affect the quality of the display device. Therefore, a new driving design is needed to solve the above problem.

BRIEF SUMMARY OF THE DISCLOSURE

An embodiment of the disclosure provides a display device and a signal-processing method thereof, so that a display device using a drive module with lower bits may have a resolution with higher bits to improve the display quality of the electronic device.

An embodiment of the disclosure provides a signal-processing method for a display device, which includes: receiving a frame signal; and converting the frame signal into a plurality of sub-frame signals in a number of N corresponding to N different sub-frame duties, wherein N is a positive integer equal to or greater than 2.

In addition, an embodiment of the disclosure provides a display device, which includes a drive module and a display module. The drive module is configured to receive a frame signal and convert the frame signal into a plurality of sub-frame signals in a number of N corresponding to N different sub-frame duties, wherein N is a positive integer equal to or greater than 2. The display module is configured to receive the N sub-frame signals and display a display frame according to the N sub-frame signals.

BRIEF DESCRIPTION OF THE DRAWINGS

The disclosure can be fully understood by reading the subsequent detailed description and examples with references made to the accompanying drawings, wherein.

DETAILED DESCRIPTION OF THE DISCLOSURE

Figure 1:
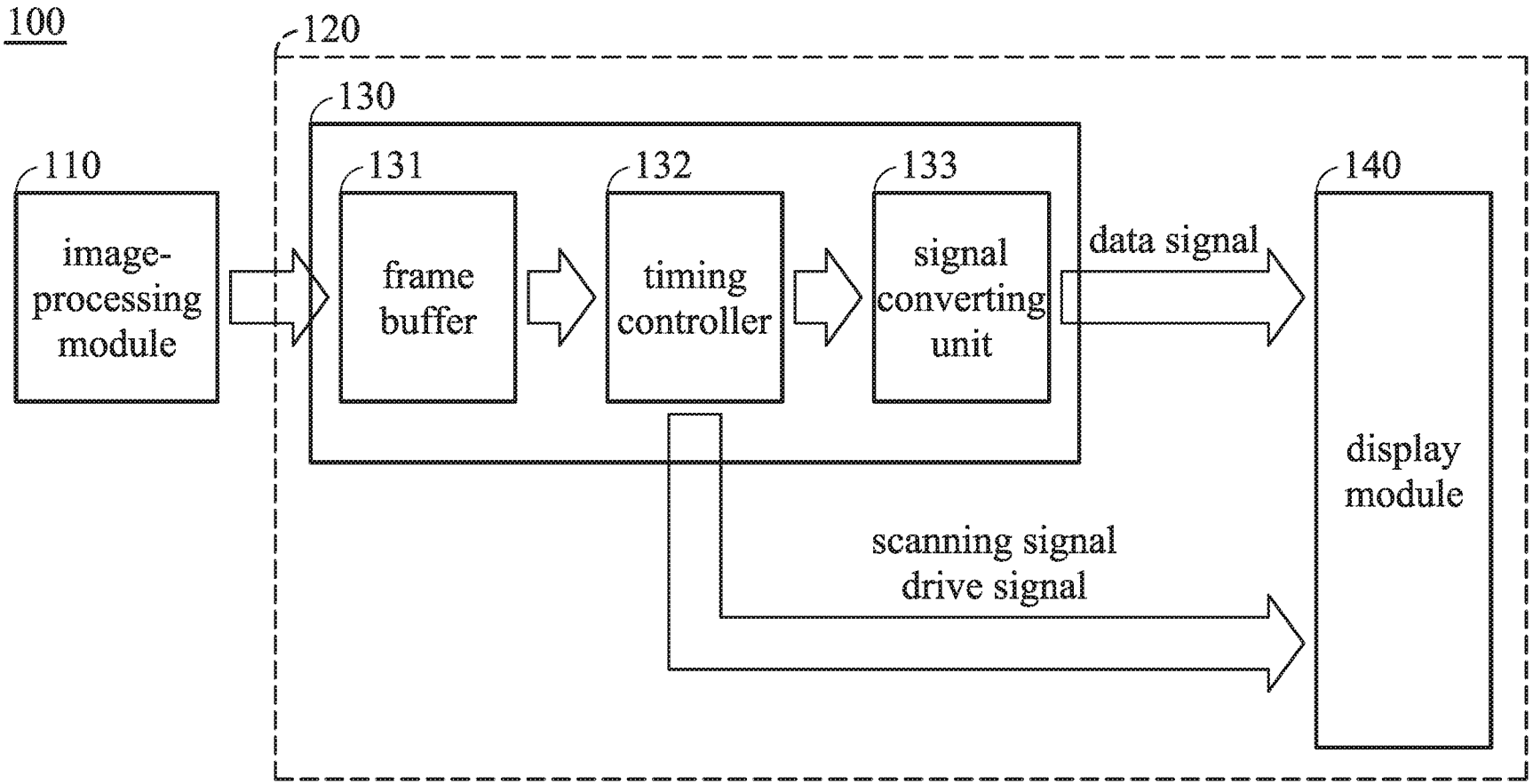
FIG. 1 is a schematic view of an electronic device according to an embodiment of the disclosure.

In order to make objects, features and advantages of the disclosure more obvious and easily understood, the embodiments are described below, and the detailed description is made in conjunction with the drawings. In order to help the reader to understand the drawings, the multiple drawings in the disclosure may merely depict a part of the entire device, and the specific components in the drawing are not drawn to scale.

The specification of the disclosure provides various embodiments to illustrate the technical features of the various embodiments of the disclosure. The configuration, quantity, and size of each component in the embodiments are for illustrative purposes only, and are not intended to limit the disclosure. In addition, if the reference number of a component in the embodiments and the drawings appears repeatedly, it is for the purpose of simplifying the description, and does not mean to imply a relationship between different embodiments.

Furthermore, use of ordinal terms such as "first", "second", etc., in the specification and the claims to describe a claim element does not by itself connote and represent the claim element having any previous ordinal term, and does not represent the order of one claim element over another or the order of the manufacturing method, either. The ordinal terms are used merely as labels to distinguish one claim element having a certain name from another element having the same name.

In some embodiments of the disclosure, unless specifically defined, the term "coupled" may include any direct and indirect means of electrical connection.

In the text, the terms "substantially" or "approximately" usually means within 20%, or within 10%, or within 5%, or within 3%, or within 2%, or within 1%, or within 0.5% of a given value or range. The quantity given here is an approximate quantity. That is, without the specific description of "substantially" or "approximately", the meaning of "substantially" or "approximately" may still be implied.

In the disclosure, the technical features of the various embodiments may be replaced or combined with each other to complete other embodiments without being mutually exclusive.

FIG. 1 is a schematic view of an electronic device according to an embodiment of the disclosure. In some embodiments, the electronic device 100 may include a liquid crystal (LC), a light-emitting diode, a quantum dot (QD), a fluorescence, a phosphor, other suitable materials, or a combination thereof, but the disclosure is not limited thereto. The light emitting diode may include, for example, an organic light-emitting diode (OLED), an inorganic light-emitting diode (LED), a mini light-emitting diode (mini LED), a micro light-emitting diode (micro LED) or a quantum dot light-emitting diode (QLED/QDLED), other suitable materials, or a combination thereof, but the disclosure is not limited thereto. In some embodiments, the electronic device 100 may be a display device, a sensing device, a lighting device, an antenna device, a touch display, a flexible device, another suitable device, or a combination thereof, but the disclosure is not limited thereto. The display device may include, for example, a spliced display device, but the disclosure is not limited thereto. Furthermore, the appearance of the electronic device may be rectangular, circular, polygonal, a shape with curved edges, or other suitable shapes.

Please refer to FIG. 1. The electronic device 100 may include an image-processing module 110 and a display device 120. The image-processing module 110 is configured to provide a frame signal, and the frame signal includes, for example, M bits signal, wherein M is a positive integer greater than or equal to 3. In addition, M bits signal corresponds to, for example, a plurality of gray level numbers of the image data of the frame signal. For example, when M is 10, the gray level numbers of the image data of the frame signal are 1024 ($2^{10}$=1024, 0-th gray level~1023-th gray level). When M is 14, the gray level numbers of the image data of the frame signal are 16384 ($2^{14}$=16384, 0-th gray level~16383-th gray level). The relationship between other gray level numbers and M may follow similar rules. The image data may be displayed by, for example, a light emitting unit or display unit of a display module 140, but the embodiment of the disclosure is not limited thereto.

The display device 120 may include a drive module 130 and the display module 140. The drive module 130 is coupled to the image-processing module 110, receives the frame signal, and converts the frame signal into a plurality of sub-frame signals in a number of N corresponding to N different sub-frame duties, wherein N is a positive integer equal to or greater than 2, and M is greater than N. In the embodiment, each of the above N sub-frame signals may include a M1 bits data signal, a scanning signal and a drive signal. In addition, M1+N=M.

Furthermore, M1 bits data signals corresponds to, for example, a plurality of gray level numbers of the image data of the sub-frame signals, wherein M1 is a positive integer greater than or equal to 1. For example, when M1 is 7, the gray level numbers of the image data of the sub-frame signals are 128 ($2^7$=128, 0-th gray level~127-th gray level). When M1 is 10, the gray level numbers of the image data of the sub-frame signals are 1024 ($2^{10}$=1024, 0-th gray level~1023-th gray level). The relationship between other gray level numbers and M1 may follow similar rules. That is, the gray level numbers of the image data corresponding to the frame signal (including the M bits signal) provided by the image-processing module 110 may be greater than the gray level numbers of the image data corresponding to the M1 bits data signal.

Furthermore, the drive module 130 may include a frame buffer 131, a timing controller 132 and a signal converting unit 133. The frame buffer 131 is coupled to the image-processing module 110, receives the frame signal, and buffers the frame signal, wherein the frame signal includes M bits signal. The timing controller 132 is coupled to the frame buffer 131, receives the frame signal provided by the frame buffer 131, and converts the frame signal into the N sub-frame signals, wherein each of the N sub-frame signals may include a first data signal of M1 bits, a scanning signal and a drive signal. In other words, the timing controller 132 may converts the M bits signal into the first data signal of M1 bits. Then, the timing controller 132 converts the first data signal of M1 bits of each of the N sub-frame signals into a second data signal of M1 bits according to the data signal of N bits, wherein M1+N=M. In some embodiments, the first data signal of M1 bits and the second data signal of M1 bits are the same or different. The timing controller 132 may also adjust the sub-frame duty of each of the N sub-frame signals according to the data signal of N bits. The signal-converting unit 133 may be a M1 bits converter. The signal-converting unit 133 is coupled to the timing controller 132, and receives and outputs the second data signal of M1 bits.

The display module 140 is coupled to the drive module 130, receives the N sub-frame signals and is driven according to the N sub-frame signals to display the display frame of the corresponding gray level brightness. In some embodiments, the display module 140 may include a plurality of display units, a plurality of data lines and a plurality of scanning lines.

In some embodiments, the N different sub-frame duties may be in a geometric sequence with a common ratio 2, for example, N different sub-frame duties increases or decreases in order of power of 2, but the embodiment of the disclosure is not limited thereto. That is, the N sub-frame signals may be correspond to different sub-frame duties, for example, the light-emitting time lengths of the display unit or the light emitting unit corresponding to the N sub-frame signals are different. For example, the sub-frame duty ($2^N$T) corresponding to the first sub-frame signal is substantially twice as long as the sub-frame duty ($2^{(N-1)}$T) corresponding to the second sub-frame signal, the sub-frame duty ($2^{(N-1)}$T) corresponding to the second sub-frame signal is substantially twice as long as the sub-frame duty ($2^{(N-2)}$T) corresponding to the third sub-frame signal, . . . , the sub-frame duty (such as ($2^1$T)=2T) corresponding to the (N−1)-th sub-frame signal is substantially twice as long as the sub-frame duty (such as ($2^0$T)=1T) corresponding to the N-th sub-frame signal. In addition, the first sub-frame duty ($2^N$T) is substantially occupied 50% of the sum of the first sub-frame duty to the N-th sub-frame duty, and the second sub-frame duty ($2^{N-1}$T) is substantially occupied 25% of the sum of the first sub-frame duty to the N-th sub-frame duty. The relationship between other sub-frame duty and the sum of the first sub-frame duty to the N-th sub-frame duty may follow similar rules.

The "N" described in some embodiments of the disclosure, for example, the N bits, the N sub-frame signals, the N different sub-frame duties, the N of the duty ($2^N$T) or other N may be the same N value, and the description thereof is not repeated in the following text.

In some embodiments, the N different sub-frame duties may be arranged in a common ratio 2 but not a geometric sequence. Assume that N is 4. For example, in an embodiment, the sub-frame duty corresponding to the first sub-frame signal is substantially 8T (such as 8T, 7.9T, 7.8T, 8.1T, or 8.2T, etc.), the sub-frame duty corresponding to the second sub-frame signal is substantially 2T (such as 2T, 1.9T, 1.8T, 2.1T, or 2.2T, etc.), the sub-frame duty corresponding to the third sub-frame signal is substantially 4T (such as 4T, 3.9T, 3.8T, 4.1T, or 4.2T, etc.), and the sub-frame duty corresponding to the fourth sub-frame signal is substantially 1T (such as 1T, 0.9T, 0.8T, 1.1T, or 1.2T, etc.). In another embodiment, the sub-frame duty corresponding to the first sub-frame signal is substantially 4T, the sub-frame duty corresponding to the second sub-frame signal is substantially 8T, the sub-frame duty corresponding to the third sub-frame signal is substantially 1T, and the sub-frame duty corresponding to the fourth sub-frame signal is substantially 2T. The arrangement of the sub-frame duties may be designed according to design requirements, but the above embodiment is not limited thereto.

In some embodiments, M1 bits of the M bits signal are used for determining the original gray level of each of the sub-frame signal. That is, the first data signal of M1 bits may be used for determining the original gray level of each of the sub-frame signals. For example, when M1=7, the gray level numbers of the image data of the sub-frame signal are 128 ($2^7$=128). That is, the image data of the sub-frame signal may display any gray level from 0-th gray level to 127-th gray level, and therefore any gray level from 0-th gray level to 127-th gray level may be the original gray level. When M1=10, the gray level numbers of the image data of the sub-frame signal are 1024 ($2^{10}$=1024). That is, the image data of the sub-frame signal may display any gray level from 0-th gray level to 1023-th gray level, and therefore any gray level from 0-th gray level to 1023-th gray level may be the original gray level. N bits of the M bits signal may be used for determining whether to convert each of the sub-frame signals into a predetermined gray level from the original gray level. That is, the N bits may be used for determining whether to maintain each of the sub-frame signals as the original gray level or to converts each of the sub-frame signals into the predetermined gray level. In addition, the predetermined gray level is, for example, an adjacent gray level of the original gray level. In some embodiments, the predetermined gray level is, for example, a next gray level of the original gray level. For example, assume that the original gray level is 120-th gray level, and the predetermined gray level is 121-th gray level. Assume that the original gray level is 50-th gray level, and the predetermined gray level is 51-th gray level. The relationship between other original gray levels and the predetermined gray levels may follow similar rules, but the disclosure is not limited thereto.

In some embodiments, the predetermined gray level is, for example, a previous gray level of the original gray level, and the same effect may also be achieved. For example, assume that the original gray level is 121-th gray level, and the predetermined gray level is 120-th gray level. Assume that the original gray level is 51-th gray level, and the predetermined gray level is 50-th gray level. The relationship between other original gray levels and the predetermined gray levels may follow similar rules, but the disclosure is not limited thereto.

In addition, the N bits may include, for example, N digits combined by "0" or "1", and "0" or "1" may be a setting value for determining whether to maintain each of the N sub-frame signals as the original gray level or convert each of the N sub-frame signals into the predetermined gray level. For example, when the setting value is set to "0", the sub-frame signal maintains as the original gray level, such as 120-th gray level. When the setting value is set to "1", the sub-frame signal is converted from the original gray level into the predetermined gray level, such as 121-th gray level. In another embodiment, when the setting value is set to "1", the sub-frame signal may also be, for example, 119-th gray level, but the disclosure is not limited thereto.

Furthermore, the N digit numbers of the N bits may include $2^N$ combinations, and the N-th digit number of the N bits may correspond to the setting value of the N-th sub-frame signal. Assume that N=4, the setting value of the four sub-frame signal may include 16 ($2^4$) combinations, but the disclosure is not limited thereto. For example, "0000", "0001", "0010", "0011", "0100", "0101", "0110", "0111", "1000", "1001", "1010", "1011", "1100", "1101", "1110", and "1111".

For example, when the setting value of the four sub-frame signals is "0000", it indicates that the first to fourth sub-frame signals maintain as the original gray level. When the setting value of the four sub-frame signals is "0001", it indicates that the first to third sub-frame signals maintains as the original gray level, and the fourth sub-frame signal is converted into the predetermined gray level. When the setting value of the four sub-frame signals is "0110", it indicates that the first sub-frame signal and the fourth sub-frame signal maintain as the original gray level, and the second sub-frame signal and the third sub-frame signal are converted into the predetermined gray level. When the setting value of the four sub-frame signals is "1111", it indicates that the first to fourth sub-frame signals are converted into the predetermined gray level. The setting manner of the other setting values of the four sub-frame signals may follow similar rules. That is, the frame signal is divided into the N sub-frame signals, and the N sub-frame signals may correspond to the N different sub-frame duties, so that the display module 140 may represent the original gray level, the predetermined gray level, or the gray level between the original gray level and the predetermined gray level.

According the description of the above embodiment, the display module 140 may represent the more detailed gray level between the two gray levels (such as the original gray level and the predetermined gray level), so that the display device 120 using the drive module 130 with the lower bits may have a resolution with higher bits to improve the display quality of the electronic device 100.

Figure 2:
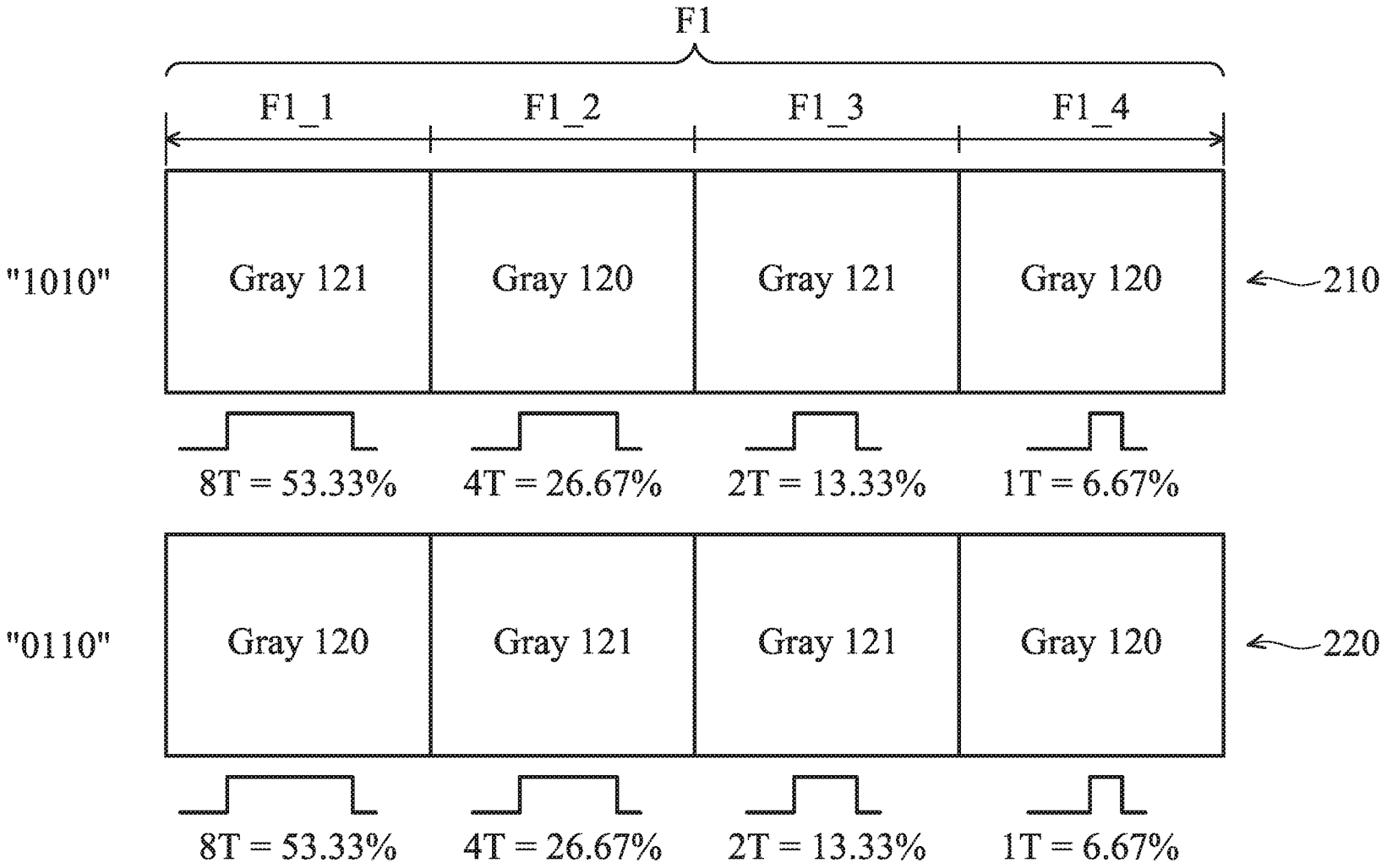
FIG. 2 is a schematic view of driving a display device according to an embodiment of the disclosure.

FIG. 2 is a schematic view of driving a display device according to an embodiment of the disclosure. For convenience of description, in the embodiment, N is 4, the original gray level is a 120-th gray level, and the predetermined gray level is a 121-th gray level, but the embodiment of the disclosure is not limited thereto. In FIG. 2, F1 indicates a frame time of one frame signal, and F1_1, F1_2, F1_3 and F1_4 respectively indicates a sub-frame time corresponding to the sub-frame signal.

Please refer to FIG. 1 and FIG. 2. In an embodiment, one or more display units 210 of the display module 140 may correspond to the four sub-frame signals. When the setting value is "1010", it indicates that the sub-frame signal corresponding to the sub-frame time F1_1 is converted into the predetermined gray level (such as the 121-th gray level), the sub-frame signal corresponding to the sub-frame time F1_2 maintains as the original gray level (such as the 120-th gray level), the sub-frame gray level corresponding to the sub-frame time F1_3 is converted into the predetermined gray level (such as the 121-th gray level), and the sub-frame signal corresponding to the sub-frame time F1_4 maintains as the original gray level (such as the 120-th gray level).

In addition, the sub-frame duty corresponding to the sub-frame time F1_1 is substantially, for example, 8T (approximately occupied 53.33% of the sum of four sub-frame duties), the sub-frame duty corresponding to the sub-frame time F1_2 is substantially, for example, 4T (approximately occupied 26.67% of the sum of four sub-frame duties), the sub-frame duty corresponding to the sub-frame time F1_3 is substantially, for example, 2T (approximately occupied 13.33% of the sum of four sub-frame duties), and the sub-frame duty corresponding to the sub-frame time F1_4 is substantially, for example, 1T (approximately occupied 6.67% of the sum of four sub-frame duties). At this time, the brightness represented by the display unit 210 of the display module 140 corresponding to the four sub-frame signals may correspond to 120.67-th ((121×8T+120×4T+121×2T+120×1T)/15T) gray level. In some embodiments, the sub-frame times and the sub-frame duties may be the same or different, but the disclosure is not limited thereto.

In another embodiment, one or more display units 220 of the display module 140 may correspond to the four sub-frame signals. When the setting value is "0110", it indicates that the sub-frame signal corresponding to the sub-frame time F1_1 maintains as the original gray level (such as the 120-th gray level), the sub-frame signal corresponding to the sub-frame time F1_2 is converted into the predetermined gray level (such as the 121-th gray level), the sub-frame signal corresponding to the sub-frame time F1_3 is converted into the predetermined gray level (such as the 121-th gray level), and the sub-frame signal corresponding to the sub-frame time F1_4 maintains the original gray level (such as the 120-th gray level).

In addition, the sub-frame duty corresponding to the sub-frame time F1_1 is substantially, for example, 8T, the sub-frame duty corresponding to the sub-frame time F1_2 is substantially, for example, 4T, the sub-frame duty corresponding to the sub-frame time F1_3 is substantially, for example, 2T, and the sub-frame duty corresponding to the sub-frame time F1_4 is substantially, for example, 1T. At this time, the brightness represented by the display unit 220 of the display module 140 corresponding to the four sub-frame signals may correspond to 120.4-th ((120×8T+121×4T+121×2T+120×1T)/15T) gray level. The brightness displayed by the display unit of the display module 140 corresponding to other setting values of the four sub-frame signals may follow similar rules. In another embodiments, the sub-frame duty corresponding to the sub-frame time F1_1 is substantially, for example, 2T, the sub-frame duty corresponding to the sub-frame time F1_2 is substantially, for example, 4T, the sub-frame duty corresponding to the sub-frame time F1_3 is substantially, for example, 1T, and the sub-frame duty corresponding to the sub-frame time F1_4 is substantially, for example, 8T. The sub-frame duties may be adjusted according to design requirements, and the disclosure is not limited thereto.

It can be seen from the embodiment of FIG. 2 that the display module 140 of the embodiment of the disclosure may represent the more detailed gray level between the original gray level (such as the 120-th gray level) and the predetermined gray level (such as the 121-th gray level), so that the display device 120 using the drive module 130 with the lower bits may have a resolution with higher bits to improve the display quality of the electronic device 100.

Figure 3:
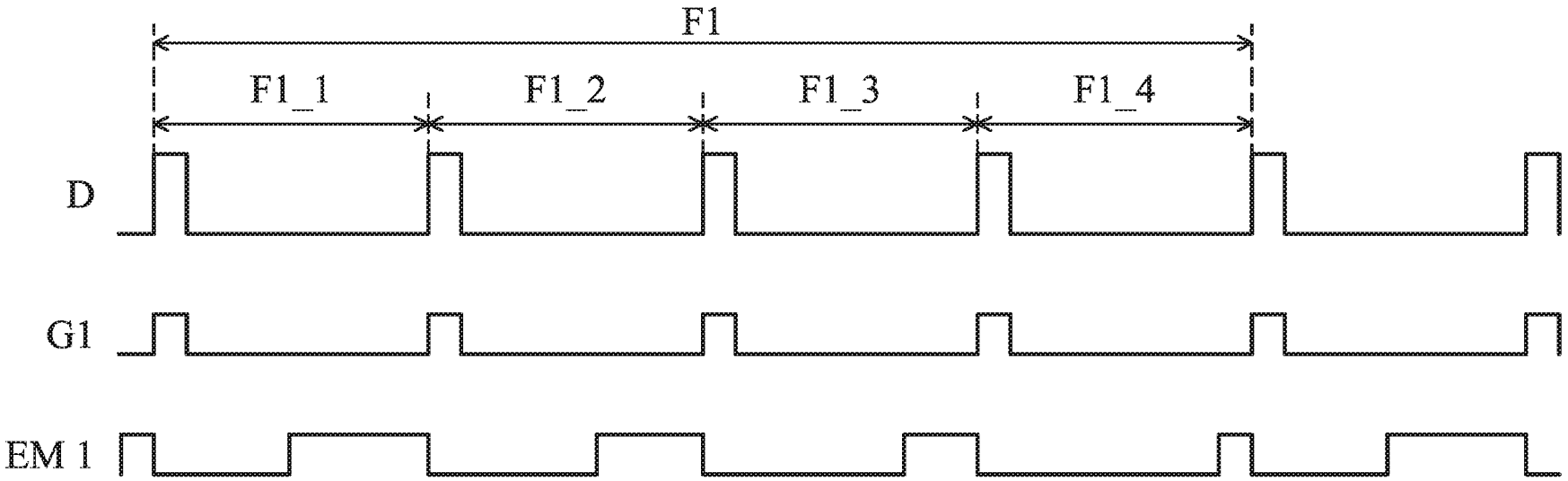
FIG. 3 is a timing diagram of driving a display device according to an embodiment of the disclosure.

FIG. 3 is a timing diagram of driving a display device according to an embodiment of the disclosure. In FIG. 3, F1 indicates a frame time of one frame signal, F1_1, F1_2, F1_3 and F1_4 respectively indicates a sub-frame time corresponding to the sub-frame signal, D indicates a data signal, G1 indicates a scanning signal, EM1 indicates a drive signal. The data signal D is, for example, the second data signal of M1 bits.

Figure 4:
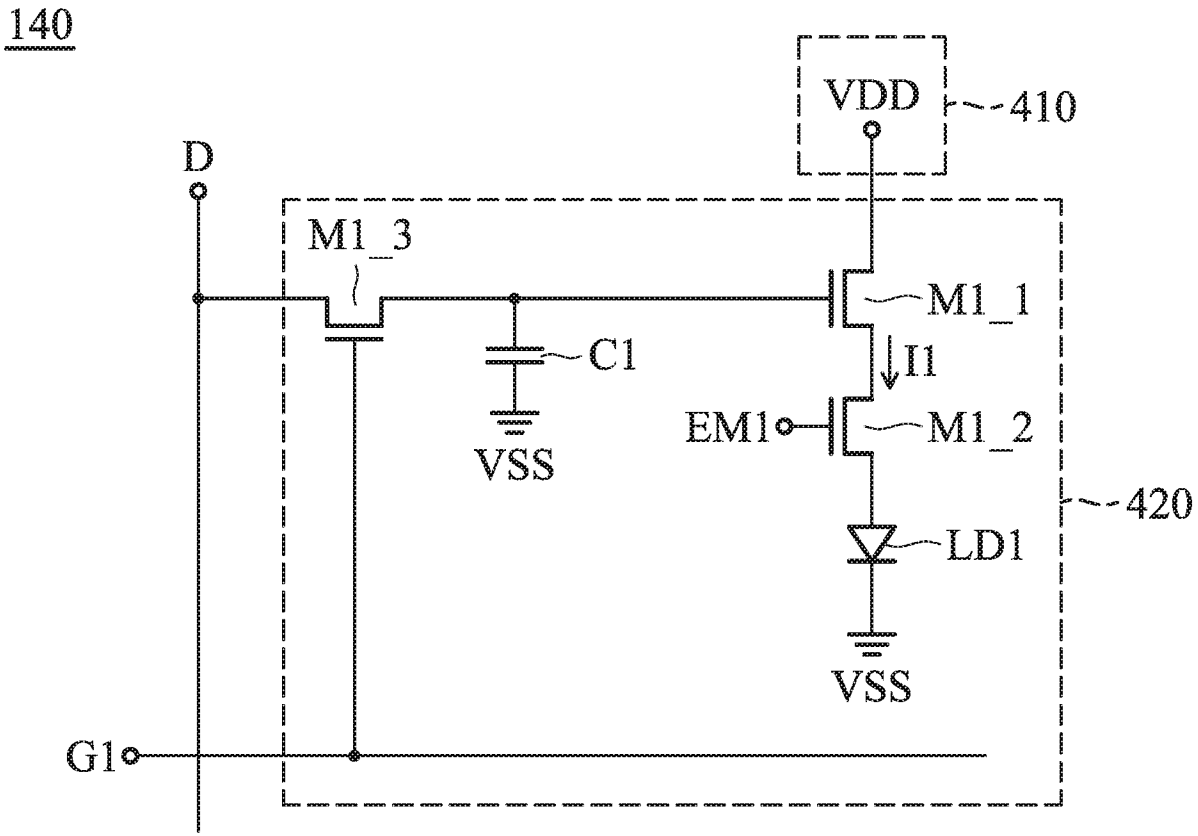
FIG. 4 is a circuit diagram of a display device according to an embodiment of the disclosure.

FIG. 4 is a circuit diagram of a display device according to an embodiment of the disclosure. Please refer to FIG. 4. The display module 140 includes a power source unit 410 and a first display unit 420. In an embodiment, the display module 140 may be a display device, but the disclosure is not limited thereto. The first display unit 420 may be a sub-pixel, but the disclosure is not limited thereto. The first display unit 420 may include a switch M1_1, a switch M1_2, a switch M1_3, a capacitor C1 and a light-emitting unit LD1. The switch M1_1 is coupled to the power source unit 410. In an embodiment, the switch M1_1 may be a thin film transistor, but the disclosure is not limited thereto. The power source unit 410 provides a power source VDD. The switch M1_2 is coupled to the switch M1_1. In an embodiment, the switch M1_2 may be a thin film transistor, but the disclosure is not limited thereto. In addition, a gate electrode of the switch M1_2 receives a drive signal EM1.

The capacitor C1 is coupled to the gate electrode of the switch M1_1. Furthermore, a first terminal of the capacitor C1 is coupled to the gate electrode of the switch M1_1, and a second terminal of the capacitor C1 may be coupled to a reference voltage VSS (such as a ground voltage).

The switch M1_3 is coupled to the switch M1_1. In an embodiment, the switch M1_3 may be a thin film transistor, but the disclosure is not limited thereto. Furthermore, the gate electrode of the switch M1_3 receives the scanning signal G1, and one terminal of the switch M1_3 receives the data signal D from the drive module 130.

The light-emitting unit LD1 is coupled to the switch M1_2. Furthermore, a first terminal (such as an anode terminal) of the light-emitting unit LD1 is coupled to one terminal of the switch M1_2, and a second terminal (such as a cathode terminal) of the light-emitting unit LD1 is coupled to the reference voltage VSS (such as a ground voltage). In some embodiments, the light-emitting unit LD1 may be an OLED, a LED, a mini LED, a micro LED, or a QLED/QD-LED) or a combination thereof, but the disclosure is not limited thereto.

Please refer to FIG. 3 and FIG. 4. In the sub-frame time F1_1, when the data signal D is at a high logic level "1" and the scanning signal G1 is at the high logic level "1", the switch M1_3 is turned on, so that the data signal D charges the capacitor C1. Then, after the capacitor C1 is charged, the switch M1_1 may have a first impedance, so that the power source VDD generates a first current signal I1 according to the corresponding impedance. Afterward, when the drive signal EM1 is at the high logic level "1", the switch M1_2 is turned on, so that the light-emitting unit LD1 is driven by the first current signal I1 to emit a light. At this time, the brightness represented by the light-emitting unit LD1 in the sub-frame time F1_1 may correspond to the sub-frame duty 8T.

In the sub-frame time F1_2, when the data signal D is at the high logic level "1" and the scanning signal G1 is at the high logic level "1", the switch M1_3 is turned on, so that the data signal D charges the capacitor C1. Then, after the capacitor C1 is charged, the switch M1_1 may have the first impedance, so that the power source VDD generates the first current signal I1 according to the corresponding impedance. Afterward, when the drive signal EM1 "1", the switch M1_2 is turned on, so that the light-emitting unit LD1 is driven by the first current signal I1 to emit the light. At this time, the brightness represented by the light-emitting unit LD1 in the sub-frame time F1_2 may correspond to the sub-frame duty 4T.

In the sub-frame time F1_3, when the data signal D is at the high logic level "1" and the drive signal G1 is at the high logic level "1", the switch M1_3 is turned on, so that the data signal D charges the capacitor C1. Then, after the capacitor C1 is charged, the switch M1_1 may have the first impedance, so that the power source VDD generates the first current signal I1 according to the corresponding impedance. Afterward, when the drive signal EM1 is at the high logic level "1", the switch M1_2 is turned on, so that the light-emitting unit LD1 is driven by the first drive signal I1 to emit the light. At this time, the brightness represented by the light-emitting unit LD1 in the sub-frame time F1_3 may correspond to the sub-frame duty 2T.

In the sub-frame time F1_4, when the data signal D is at the high logic level "1" and the scanning signal G1 is at the high logic level "1", the switch M1_3 is turned on, so that the data signal D charges the capacitor C1. Then, after the capacitor C1 is charged, the switch M1_1 may have the first impedance, so that the power source VDD generates the first current signal I1 according to the corresponding impedance. Afterward, when the drive signal EM1 is at the high logic level "1", the switch M1_2 is turned on, so that the light-emitting unit LD1 is driven by the first current signal I1 to emit the light. At this time, the brightness represented by the light-emitting unit LD1 in the sub-frame time F1_4 may correspond to the sub-frame duty 1T.

The setting manner of the data signal D corresponding to the sub-frame time F1_1, the sub-frame time F1_2, the sub-frame time F1_3 and the sub-frame time F1_4 may refer to the setting of the above embodiment. For example, when the setting value of the data signal D corresponding to the sub-frame time F1_1, the sub-frame time F1_2, the sub-frame time F1_3 and the sub-frame time F1_4 is "0110", the data signal D corresponding to the sub-frame time F1_1 maintains as the original data (such as the 120-th gray level, i.e., the original gray level), the data signal D corresponding to the sub-frame time F1_2 is converted into the predetermined data (such as the 121-th gray level, i.e., the predetermined gray level), the data signal D corresponding to the sub-frame time F1_3 is converted into the predetermined data (such as the 121-th gray level, i.e., the predetermined gray level), and the data signal D corresponding to the sub-frame time F1_4 maintains as the original data (such as the 120-th gray level, i.e., the original gray level). Therefore, the brightness represented by the first display unit 420 may correspond to 120.4-th ((120×8T+121×4T+121×2T+120×1T)/15T) gray level. The relationship between other setting value of the data signal D and the brightness represented by the first display unit 420 may follow similar rules.

Therefore, the display module 140 of the embodiment of the disclosure may represent the more detailed gray level between the original gray level (such as the 120-th gray level) and the predetermined gray level (such as the 121-th gray level), so that the display device 120 using the drive module 130 with the lower bits may have a resolution with higher bits to improve the display quality of the electronic device 100.

Figure 5:
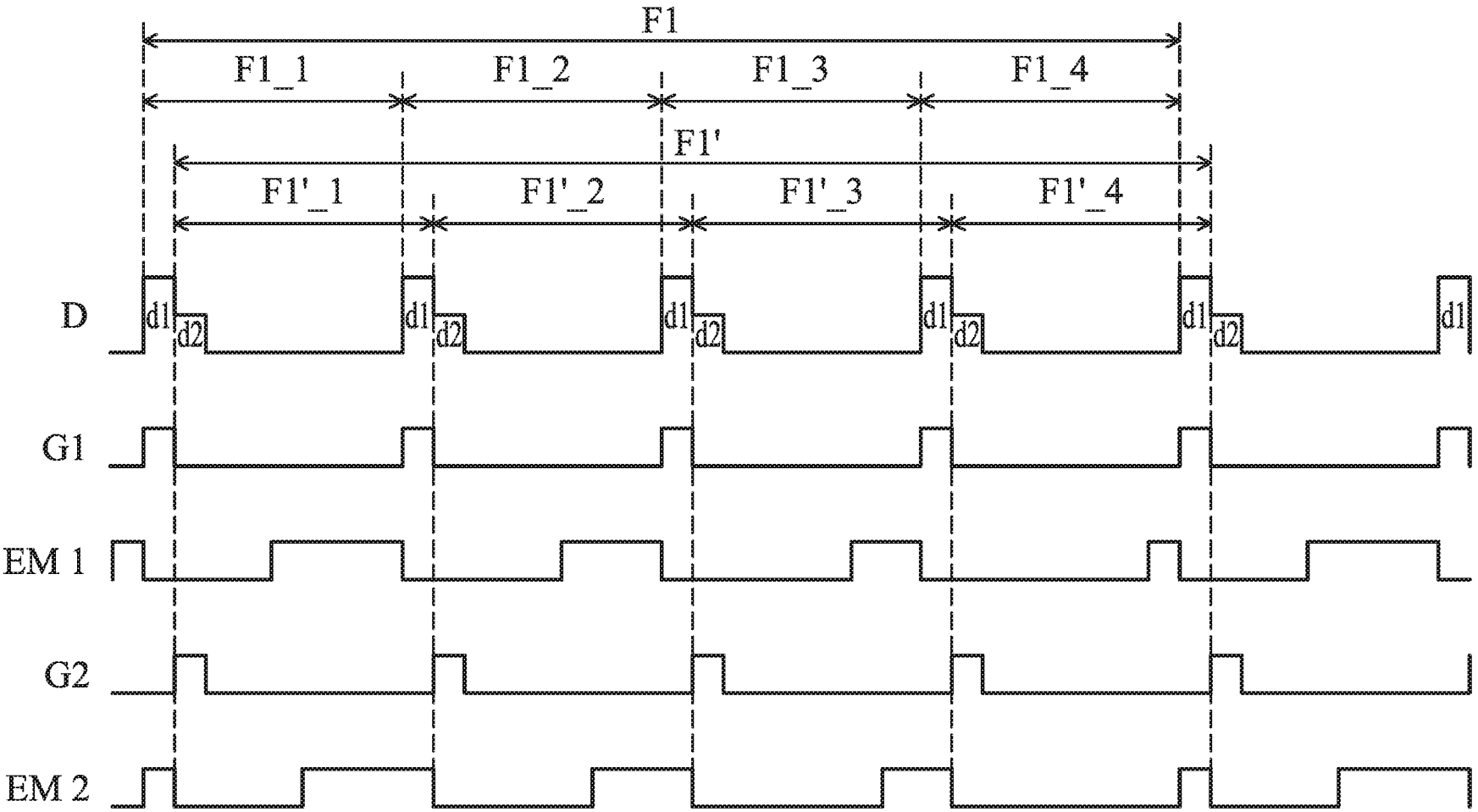
FIG. 5 is a timing diagram of driving a display device according to another embodiment of the disclosure.
Figure 6:
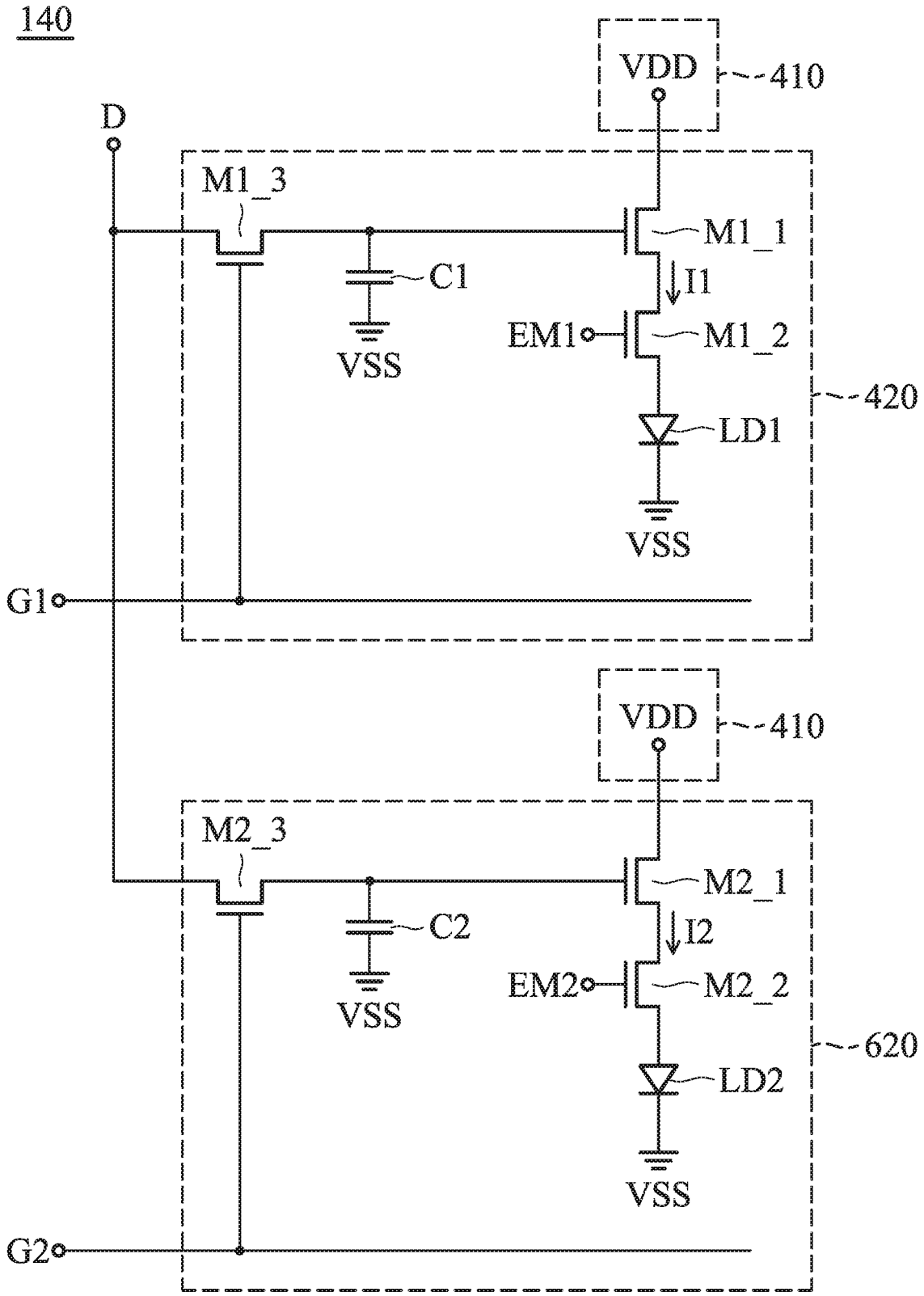
FIG. 6 is circuit diagram of a display device according to another embodiment of the disclosure.

Please refer to FIG. 5 and FIG. 6. FIG. 5 is a timing diagram of driving a display device according to another embodiment of the disclosure. In FIG. 5, F1 indicates a frame time of one frame signal of the first display unit 420. F1_1, F1_2, F1_3 and F1_4 respectively indicates a sub-frame time corresponding to the sub-frame signal. F1' indicates a frame time of one frame signal of the second display unit 620. F1'_1, F1'_2, F1'_3 and F1'_4 respectively indicates a sub-frame time corresponding to the sub-frame signal. D indicates a data signal, d1 indicates the sub data signal (such as the second data signal of M1 bits) of the data signal D corresponding to the first display unit 420, d2 indicates the sub data signal of the data signal D of the second display unit 620, G1 indicates a scanning signal corresponding to the first display unit 420, EM1 indicates a drive signal corresponding to the first display unit 420, G2 indicates a scanning signal corresponding to the second display unit 620, and EM2 indicates a drive signal corresponding to the second display unit 620.

FIG. 6 is circuit diagram of a display device according to another embodiment of the disclosure. Please refer to FIG. 6. The display module 140 includes a power source unit 410, a first display unit 420 and a second display unit 620. In an embodiment, the display module 140 may be a display panel, but the disclosure is not limited thereto. The first display unit 420 and the second display unit 620 may be sub-pixels, but the disclosure is not limited thereto.

In addition, the power source unit 410 and the first display unit 420 of FIG. 6 are the same as or similar to the power source 410 and the first display unit 420 of FIG. 4. The power source unit 410 and the first display unit 420 of FIG. 6 may refer to the description of the embodiment of FIG. 4, and the description thereof is not repeated herein.

The second display unit 620 includes a switch M2_1, a switch M2_2, a switch M2_3, a capacitor C2 and a light-emitting unit LD2. The second display unit 620 is connected to the power source 410. The switch M2_1 is coupled to the power source unit 410. In an embodiment, the switch M2_1 may be a thin film transistor, but the disclosure is not limited thereto.

The switch M2_2 is coupled to the switch M2_1. In an embodiment, the switch M2_2 may be a thin film transistor, but the disclosure is not limited thereto. In addition, a gate electrode of the switch M2_2 receives a drive signal EM2.

The capacitor C2 is coupled to the gate electrode of the switch M2_1. Furthermore, a first terminal of the capacitor C2 is coupled to the gate electrode of the switch M2_2, and a second terminal of the capacitor C2 may be coupled to a reference voltage VSS (such as a ground voltage).

The switch M2_3 is coupled to the switch M2_1. In an embodiment, the switch M2_3 may be a thin film transistor, but the disclosure is not limited thereto. Furthermore, the gate electrode of the switch M2_3 receives the scanning signal G2 and one terminal of the switch M2_3 receives the data signal D from the drive module 130.

The light-emitting unit LD2 is coupled to the switch M2_2. Furthermore, a first terminal (such as an anode terminal) of the light-emitting unit LD2 is coupled to one terminal of the switch M2_2, and a second terminal (such as a cathode terminal) of the light-emitting unit LD2 is coupled to the reference voltage VSS (such as a ground voltage). In some embodiments, the light-emitting unit LD2 may be may be an OLED, a LED, a mini LED, a micro LED, or a QLED/QD-LED) or a combination thereof, but the disclosure is not limited thereto.

Please refer to FIG. 5 and FIG. 6. In the sub-frame time F1_1, when the sub data signal d1 of the data signal D is at the high logic level "1" and the scanning signal G1 is at the high logic level "1", the switch M1_3 is turned on, so that the sub data signal d1 of the data signal D charges the capacitor C1. Then, after the capacitor C1 is charged, the switch M1_1 may have a first impedance, so that the power source VDD generate a first current signal I1 according to the first impedance. Afterward, in the sub-frame time F1'_1, when the sub data signal d2 of the data signal D is at the high logic level "1" and the scanning signal G2 is at the high logic level "1", the switch M2_3 is turned on, so that the sub data signal d2 of the data signal D charges the capacitor C2.

Then, after the capacitor C2 is charged, the switch M2_1 may have a second impedance, so that the power source VDD generate a second current signal I2 according to the second impedance. Afterward, when the drive signal EM1 is at the high logic level "1", the switch M1_2 is turned on, so that the light-emitting unit LD1 is driven by the first current signal I1 to emit the light. At this time, the brightness represented by the light-emitting unit LD1 in the sub-frame time F1_1 may correspond to the sub-frame duty 8T. Then, when the drive signal EM2 is at the high logic level "1", the switch M2_2 is turned on, so that the light-emitting unit LD2 is driven by the second current signal I2 to emit the light. At this time, the brightness represented by the light-emitting unit LD2 in the sub-frame time F1'_1 may correspond to the sub-frame duty 8T.

In the sub-frame time F1_2, when the sub data signal d1 of the data signal D is at the high logic level "1" and the scanning signal G1 is at the high logic level "1", the switch M1_3 is turned on, so that the sub data signal d1 of the data signal D charges the capacitor C1. Then, after the capacitor C1 is charged, the switch M1_1 may have the first impedance, so that the power source VDD generates the first current signal I1 according to the first impedance. Afterward, in the sub-frame time F1'_2, when the sub data signal d2 of the data signal D is at the high logic level "1" and the scanning signal G2 is at the high logic level "1", the switch M2_3 is turned on, so that the sub data signal d2 of the data signal D charges the capacitor C2.

Then, after the capacitor C2 is charged, the switch M2_1 may have the second impedance, so that the power source VDD generates the second current signal I2 according to the second impedance. Afterward, when the drive signal EM1 is at the high logic level "1", the switch M1_2 is turned on, so that the light-emitting unit LD1 is driven by the first current signal I1 to emit the light. At this time, the brightness represented by the light-emitting unit LD1 in the sub-frame time F1_2 may correspond to the sub-frame duty 4T. Then, when the drive signal EM2 is at the high logic level "1", the switch M2_2 is turned on, so that the light-emitting unit LD2 is driven by the second current signal I2 to emit the light. At this time, the brightness represented by the light-emitting unit LD2 in the sub-frame time F1'_2 may correspond to the sub-frame duty 4T.

In the sub-frame time F1_3, when the sub data signal d1 of the data signal D is at the high logic level "1" and the scanning signal G1 is at the high logic level "1", the switch M1_3 is turned on, so that the sub data signal d1 of the data signal D charges the capacitor C1. Then, after the capacitor C1 is charged, the switch M1_1 may have the first impedance, so that the power source VDD generates the first current signal I1 according to the first impedance. Afterward, in the sub-frame time F1'_3, when the sub data signal d2 of the data signal D is at the high logic level "1" and the scanning signal G2 is at the high logic level "1", the switch M2_3 is turned on, so that the sub data signal d2 of the data signal D charges the capacitor C2.

Then, after the capacitor C2 is charged, the switch M2_1 may have the second impedance, so that the power source VDD generates the second current signal I2 according to the second impedance. Afterward, when the drive signal EM1 is at the high logic level "1", the switch M1_2 is turned on, so that the light-emitting unit LD1 is driven by the first current signal I1 to emit the light. At this time, the brightness represented by the light-emitting unit LD1 in the sub-frame time F1_3 may correspond to the sub-frame duty 2T. Then, when the drive signal EM2 is at the high logic level "1", the switch M2_2 is turned on, so that the light-emitting unit LD2 is driven by the second current signal I2 to emit the light. At this time, the brightness represented by the light-emitting unit LD2 in the sub-frame time F1'_3 may correspond to the sub-frame duty 2T.

In the sub-frame time F1_4, when the sub data signal d1 of the data signal D is at the high logic level "1" and the scanning signal G1 is at the high logic level "1", the switch M1_3 is turned on, so that the sub data signal d1 of the data signal D charges the capacitor C1. Then, after the capacitor C1 is charged, the switch M1_1 may have the first impedance, so that the power source VDD generates the first current signal I1 according to the first impedance. Afterward, in the sub-frame time F1'_4, when the sub data signal d2 of the data signal D is at the high logic level "1" and the scanning signal G2 is at the high logic level "1", the switch M2_3 is turned on, so that the sub data signal d2 of the data signal D charges the capacitor C2.

Then, after the capacitor C2 is charged, the switch M2_1 may have the second impedance, so that the power source VDD generates the second current signal I2 according to the second impedance. Afterward, when the drive signal EM1 is at the high logic level "1", the switch M2_3 is turned on, so that the light-emitting unit LD1 is driven by the first current signal I1 to emit the light. At this time, the brightness represented by the light-emitting unit LD1 in the sub-frame time F1_4 may correspond to the sub-frame duty 1T. Then, when the drive signal EM2 is at the high logic level "1", the switch M2_2 is turned on, so that the light-emitting unit LD2 is driven by the second current signal I2 to emit the light. At this time, the brightness represented by the light-emitting unit LD2 in the sub-frame time F1'_4 may correspond to the sub-frame duty 1T.

The setting manner of the sub data signal d1 corresponding to the sub-frame time F1_1, the sub-frame time F1_2, the third sub-frame time F1_3 and the sub-frame F1_4 may refer to the setting of the above embodiment. For example, when the setting value of the sub data signal d1 corresponding to the sub-frame time F1_1, the sub-frame time F1_2, the sub-frame time F1_3 and the sub frame time F1_4 is "0110", the sub data signal d1 corresponding to the sub-frame time F1_1 maintains as the original data (such as the 120-th gray level), the sub data signal d1 corresponding to the sub-frame time F1_2 is converted into the predetermined data (such as the 121-th gray level), the sub data signal d1 corresponding to the sub-frame time F1_3 is converted into the predetermined data (such as the 121-th gray level), and the sub data signal corresponding to the sub-frame time F1_4 maintains the original data (such as the 120-th gray level). Therefore, the brightness represented by the first display unit 420 may corresponding to the 120.4-th ((120×8T+121×4T+121×2T+120×1T)/15T) gray level. The relationship between other setting value of the sub data signal d1 and the brightness represented by the first display unit 420 may follow similar rules. That is, the gray level corresponding to the first display unit 420 is a weighted average of the gray level of the four sub-frames corresponding to the different sub-frame duties.

In addition, the setting manner of the sub data signal d2 corresponding to the sub-frame time F1'_1, the sub-frame time F1'_2, the sub-frame time F1'_3 and the sub-frame time F1'_4 may refer to the setting of the above embodiment. For example, the setting value of the sub data signal d2 corresponding to the sub-frame time F1'_1, the sub-frame time F1_2, the sub-frame time F1'_3 and the sub-frame time F1'_4 is "1010", the sub data signal d2 corresponding to the sub-frame time F1'_1 is converted into the predetermined data (such as the 121-th gray level), the sub data signal d2 corresponding to the sub-frame time F1'_2 maintains as the original data (such as the 120-th gray level), the sub data signal d2 corresponding to the sub-frame time F1'_3 is converted into the predetermined data (such the 121-th gray level), and the sub data signal d2 corresponding to the sub-frame time F1'_4 maintains as the original data (such as the 120-th gray level). Therefore, the brightness represented by the second display unit 620 may correspond to the 120.67-th ((121×8T+120×4T+121×2T+120×1T)/15T) gray level. The relationship between other setting value of the sub data signal d2 and the brightness represented by the second display unit 620 may follow similar rules. That is, the gray level corresponding to the second display unit 620 is a weighted average of the gray level of the four sub-frames corresponding to the different sub-frame duties.

Therefore, the display module 140 of the embodiment of the disclosure may represent the more detailed gray level between the original gray level (such as the 120-th gray level) and the predetermined gray level (such as the 121-th gray level), so that the display device 120 using the drive module 130 with the lower bits may have a resolution with higher bits to improve the display quality of the electronic device 100.

In the embodiment of FIG. 4, the display module 140 includes the first display unit 420, and in the embodiment of FIG. 6, the display module 140 includes the first display unit 420 and the second display unit 620, but the disclosure is not limited thereto. In some embodiments, the display module 140 may include three or more display units. When there are three or more display units, the driving manner of each of the display units may refer to the description of the above embodiments, and the description thereof is not repeated herein.

Figure 7:
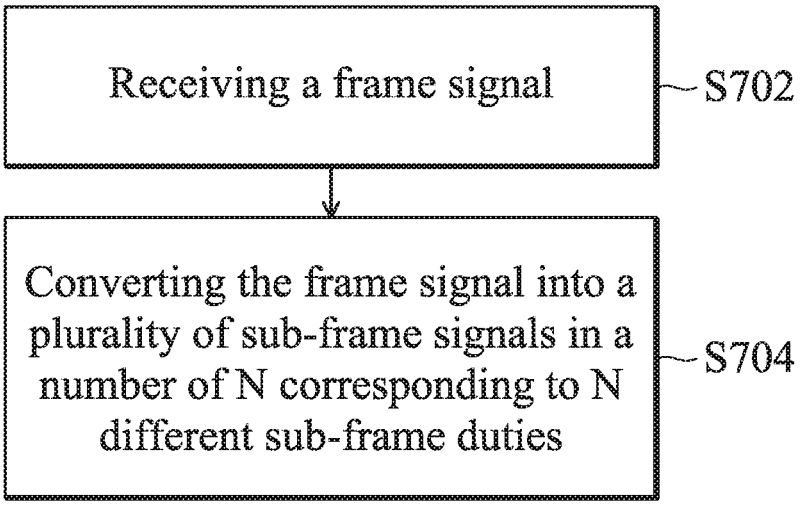
FIG. 7 is a flowchart of a signal-processing method for a display device according to an embodiment of the disclosure.

FIG. 7 is a flowchart of a signal-processing method for a display device according to an embodiment of the disclosure. In step S702, the method involves receiving a frame signal. In step S704, the method involves converting the frame signal into a plurality of sub-frame signals in a number of N corresponding to N different sub-frame duties. In some embodiments, the N different sub-frame duties may be in a geometric sequence with a common ratio 2. In some embodiments, the frame signal includes M bits signal, wherein M is greater than N, M is a positive integer greater than or equal to 3, and N is a positive integer equal to or greater than 2. In some embodiments, N bits of the M bits signal are for determining whether to convert each of the N sub-frame signals into a predetermined gray level. Furthermore, M1 bits of the M bits are for determining the original gray level, the predetermined gray level is an adjacent gray level of the original gray level, wherein M1 is a positive integer greater than or equal to 1, and the predetermined gray level may be the next gray level of the original gray level or a previous gray level of the original gray level. In some embodiments, M1+N=M. In some embodiments, the N bits include N digits combined by "0" or "1", and "0" or "1" is for determining to maintain each of the N sub-frame signals as the original gray level or convert each of the N sub-frame signals into the predetermined gray level.

In summary, according to the display device and the signal-processing method thereof in the embodiments of the disclosure, the frame signal is converted into the plurality of sub-frame signals in a number of N corresponding to N different sub-frame duties, wherein N is a positive integer equal to or greater than 2. Therefore, the display device using the drive module with lower bits may have a resolution with higher bits to improve the display quality of the electronic device.

While the disclosure has been described by way of examples and in terms of the preferred embodiments, it should be understood that the disclosure is not limited to the disclosed embodiments. On the contrary, it is intended to cover various modifications, combinations, and similar arrangements (as would be apparent to those skilled in the art). Therefore, the scope of the appended claims should be accorded the broadest interpretation to encompass all such modifications, combinations, and similar arrangements.

What is claimed is:

1. A signal-processing method for a display device, comprising:

receiving a frame signal; and converting the frame signal into a plurality of sub-frame signals in a number of N corresponding to N different sub-frame duties, wherein N is a positive integer equal to or greater than 2;

wherein the frame signal comprises M bits signal, N bits of the M bits signal are for determining whether to convert each of the N sub-frame signals into a predetermined gray level, M1 bits of the M bits are for determining an original gray level, the predetermined gray level is an adjacent gray level of the original gray level, M is greater than N, M is a positive integer greater than or equal to 3, M1 is a positive integer greater than or equal to 1.

2. The signal-processing method for the display device according to claim 1, wherein the N different sub-frame duties are in a geometric sequence with a common ratio 2.

3. The signal-processing method for the display device according to claim 1, wherein M1+N=M.

4. The signal-processing method for the display device according to claim 1, wherein the predetermined gray level is a next gray level of the original gray level.

5. The signal-processing method for the display device according to claim 1, wherein the predetermined gray level is a previous gray level of the original gray level.

6. The signal-processing method for the display device according to claim 1, wherein the N bits comprise N digits combined by "0" or "1", and "0" or "1" is for determining to maintain each of the N sub-frame signals as the original gray level or convert each of the N sub-frame signals into the predetermined gray level.

7. The signal-processing method for the display device according to claim 1, wherein each of the N sub-frame signals comprises a data signal, a scanning signal, and a drive signal.

8. A display device, comprising:

a drive module, configured to receive a frame signal and convert the frame signal into a plurality of sub-frame signals in a number of N corresponding to N different sub-frame duties, wherein N is a positive integer equal to or greater than 2; and a display module, configured to receive the N sub-frame signals and display a display frame according to the N sub-frame signals;

wherein the frame signal comprises M bits signal, N bits of the M bits signal are for determining whether to convert each of the N sub-frame signals into a predetermined gray level, M1 bits of the M bits are for determining an original gray level, the predetermined gray level is an adjacent gray level of the original gray level, M is greater than N, M is a positive integer greater than or equal to 3, M1 is a positive integer greater than or equal to 1.

9. The display device according to claim 8, wherein the N different sub-frame duties are in a geometric sequence with a common ratio 2.

10. The display device according to claim 8, wherein M1+N=M.

11. The display device according to claim 8, wherein the predetermined gray level is a next gray level of the original gray level.

12. The display device according to claim 8, wherein the predetermined gray level is a previous gray level of the original gray level.

13. The display device according to claim 8, wherein the N bits comprise N digits combined by "0" or "1", and "0" or "1" is for determining to maintain each of the N sub-frame signals as the original gray level or convert each of the N sub-frame signals into the predetermined gray level.

14. The display device according to claim 8, wherein each of the N sub-frame signals comprises a data signal, a scanning signal, and a drive signal.

* * * * *